US006932330B2

(12) United States Patent
Fournel et al.

(10) Patent No.: US 6,932,330 B2
(45) Date of Patent: Aug. 23, 2005

(54) METHOD FOR GENERATING AND CIRCULATING A FOAM IN AN INSTALLATION AND SYSTEM FOR APPLICATION OF THIS METHOD

(75) Inventors: Bruno Fournel, Vinon sur Verdon (FR); Maria Faury, Aix-en-Provence (FR); Jean-Marie Le Samedy, Manosque (FR)

(73) Assignee: Commissariat a l'Energie Atomique France Compagnie Generale des Matleres Nucleaires

( * ) Notice: Subject to any disclaimer, the term of this patent is extended or adjusted under 35 U.S.C. 154(b) by 0 days.

(21) Appl. No.: 10/378,882

(22) Filed: Mar. 5, 2003

(65) Prior Publication Data

US 2003/0150480 A1 Aug. 14, 2003

Related U.S. Application Data

(62) Division of application No. 09/582,529, filed as application No. PCT/FR99/00075 on Jan. 15, 1999, now Pat. No. 6,561,200.

(30) Foreign Application Priority Data

Jan. 16, 1998 (FR) ..... 98 00436

(51) Int. Cl.[7] ..... A47L 5/00

(52) U.S. Cl. ..... 261/26; 261/28; 261/30; 261/34.1; 15/320; 15/321

(58) Field of Search ..... 134/21, 22.19, 134/39, 40; 252/3; 15/320, 321; 261/DIG. 26, 28, 30, 34.1

(56) References Cited

U.S. PATENT DOCUMENTS

| | | | | |
|---|---|---|---|---|
| 4,061,152 | A | 12/1977 | Babunovic | 12/77 |
| 4,133,773 | A | 1/1979 | Moore | 1/79 |
| 4,934,393 | A | 6/1990 | Lighthall et al. | 6/90 |
| 4,969,488 | A | 11/1990 | Long et al. | 11/90 |
| 4,974,618 | A | 12/1990 | Nysted | 12/90 |
| 6,027,572 | A | 2/2000 | Labib et al. | 2/0 |
| 6,336,239 | B1 | 1/2002 | Cooper | 1/2 |
| 6,454,871 | B1 | 9/2002 | Labib et al. | 9/2 |
| 6,561,200 | B1 * | 5/2003 | Fournel et al. | 134/22.19 |

FOREIGN PATENT DOCUMENTS

| | | |
|---|---|---|
| DE | 1781104 | 10/1970 |
| GB | 2219518 | 12/1989 |
| RU | 1706681 | 1/1992 |

* cited by examiner

*Primary Examiner*—Gregory R. Del Cotto
(74) *Attorney, Agent, or Firm*—Hutchison & Mason PLLC

(57) ABSTRACT

The invention relates to a method for generating a foam from a liquid phase and a gas phase, a method for placing a foam in circulation in an installation, and a method for cleaning an installation by placing a foam in circulation.

Generation of the foam is made by aspiration of an appropriate liquid phase and an appropriate gas phase to generate a foam through a porous lining.

The invention also relates to a system for generating a foam and to a system for generating and placing a foam in circulation in an installation.

34 Claims, 3 Drawing Sheets

METHOD FOR GENERATING AND CIRCULATING A FOAM IN AN INSTALLATION AND SYSTEM FOR APPLICATION OF THIS METHOD

This application is a divisional of U.S. application Ser. No. 09/582,529, filed on Jul. 13, 2000 now U.S. Pat. No. 6,561,200, which was a national stage tiling under 35 U.S.C. § 371 of international Application No. PCT/FR99/00075 filed on Jan. 15, 1999.

TECHNICAL FIELD

The invention relates to a method for generating a foam from a liquid phase and a gas phase, a method for placing a foam in circulation in an installation, and a method for cleaning an installation by placing a foam in circulation.

The invention also relates to a system for generating a foam and to a system for generating and placing a foam in circulation in an installation.

The method of the invention may be of use for example in a method for cleaning and/or decontaminating an installation by means of a foam. Liquid phase cleaning and/or decontaminating methods for a large volume installation, having for example a complex inner geometry, generate considerable volumes of waste. The use of a foam, containing one or more cleaning and/or decontaminating agents brings a significant reduction in the volumes of waste generated. The cleaning and or decontamination of an installation is made by injection of the foam inside the installation to be cleaned and/or decontaminated, and at times by placing the foam in circulation within these installations.

The method of the invention is particularly advantageous for cleaning and/or decontaminating installations operating under low pressure such as a pneumatic carrier network for samples intended for analysis, a ventilation circuit or pipes which have undergone radioactive contamination.

PRIOR ART

Foam generation is generally conducted by mechanical shaking of a liquid, by sudden depressurising of a gas solubilized in a liquid, or by injection of gas and liquid under pressure at the inlet of a static porous medium.

For example patent application EP-A-0 526 305 describes firstly a method for preparing a foam consisting of causing a gas under pressure to pass through a sintered plate in the presence of a solution, the solution and the gas being suitable to form a foam.

The document previously cited also describes a method for cleaning an installation in which the foam is propelled into the installation by the pressure of the gas used to generate the foam. The flow rate of the gas and liquid are set so as to generate foam on entering the installation, irrespective of the characteristics of said installation to be cleaned. The method of preparing a foam and for cleaning an installation described in this document are not appropriate for cleaning sensitive installations, in particular installations for which a pressure greater than atmospheric pressure is prohibited.

It is therefore necessary to put forward a system for generating and placing a foam in circulation which operates at pressures of atmospheric pressure or less.

DISCLOSURE OF THE INVENTION

The purpose of the present invention is to provide a method for generating a foam from a liquid phase and from a gas phase with which homogeneous foam can be generated having few or no air pockets.

The method of the invention is characterised in that it comprises a step consisting of generating the foam by aspiration of the liquid phase and the gas phase through a porous lining.

The principle of the, method of the invention consists of no longer injecting liquid and gas phases under pressure through the porous lining, but of draining them through the pores or interstices of the lining by setting up constant low pressure downstream from this lining.

The gas phase and the liquid phase are aspirated simultaneously through the lining under the effect of low pressure. The porous lining therefore acts as a contacter between the gas phase and the liquid phase.

The gas phase-liquid phase mixture is made in the porous lining in which interfaces are created and therefore foam is created. The energy required for this mixture and the creation of interfaces is provided by the flow of the liquid and gas phases in the lining under the effect of low pressure.

In order to obtain a foam of constant quality when it leaves the lining, various variables need to be controlled which come into play during the generation method described above. These variables are the chemical composition of the liquid phase, also called foaming solution, the flow rate of the liquid phase arriving in contact with the porous lining, the flow rate of the gas phase drawn by aspiration, the geometry of the porous lining placed in a chamber, and the geometry of said chamber.

The chemical composition of the foaming solution is chosen in relation to the intended use of the generated foam. The foam may, for example, be a cleaning and/or decontaminating foam for an installation, and/or a scouring foam, a rinsing foam, a foam intended to apply a film having surfactant or bactericidal properties for example.

The quality of the foam may be determined for example by a lifetime, a moisture content, or its expansion. The lifetime of a foam may be defined as the time required for total conversion of a given volume of foam into liquid and gas. The moisture content of a foam may be defined as the ratio between the liquid phase volume and foam volume. Expansion F of a foam is defined, under normal temperature and pressure conditions by the following ratio (1):

$$F = \frac{V_{gas} + V_{liquid}}{V_{liquid}} = \frac{V_{foam}}{V_{liquid}}$$

in which:

F=expansion in units of expansion $V_{gas}$=the volume of the gas phase in the foam $V_{liquid}$=the volume of the liquid phase in the foam $V_{foam}$=the volume of foam.

A foam having constant quality will have constant expansion. Generally, the foams prepared with the methods of the prior art have an expansion in the order of 10 to 15. Expansion also provides a magnitude of the amount of decrease in the volume of generated liquid waste for example, when the foam is used to clean an installation.

Expansion also makes it possible to assess the quantity of air pockets present in the foam, and therefore to assess the quality of this foam.

If the foam is intended to carry out cleaning and/or decontamination and/or scouring, according to the method of the invention, the liquid phase may also comprise at least one foaming surfactant conventionally used to generate a foam, at least one foam stabilising or destabilising agent with which it is possible to modify the lifetime of the foam or its moisture content, and/or at least one cleaning agent and/or at least one decontaminating agent and/or at least one scouring agent for an installation.

If the foam is intended to carry out rinsing of an installation, the liquid phase may be an aqueous solution of at least one surfactant agent and of at least one foam destabilising agent.

In a foam composition that can be used to implement the method of the invention, the constituents of the liquid phase, in particular the foam destabilising agent, and their quantity are chosen such as to obtain a foam lifetime of 15 to 30 minutes and a moisture content of 2 to 20%.

Examples of appropriate liquid phases to implement the method of the invention are described in EP-A-0 526 305.

The destabilising agent may be an organic compound which destabilises the foam by acting on dynamic surface tension, for example an alcohol preferably having a boiling point slightly higher than that of water, for example a boiling point of 110° C. to 130° C. Preferably a C5 to C6 secondary alcohol is used, such as pentanol-2.

Generally the quantity of destabilisation agents represents from 0.2 to 1% by weight of the liquid phase.

In the liquid phase of the foam, the decontamination reagent may be made up of reagents routinely used in wet process decontamination methods. If the objects to be decontaminated are in metal, particular use is made of reagents made up of inorganic or organic acids or bases. As an example of acid reagents, mention may be made of hydrochloric acid, nitric acid, sulphuric acid and phosphoric acid which may be used alone or in combination. It is also possible to use organic reagents such as citric or oxalic acids.

As an example of basic reagents NAOH, KOH and their mixtures may be cited, to which oxidants for example may be added, such as $H_2O_2$ or the permanganate ion.

In the case of acid reagents, their concentration in the liquid phase may range for example up to 10 $mol.l^{-1}$; for base reagents, their concentration may for example reach 5 $mol.l^{-1}$.

If an acid reagent is used made up of $H_2SO_4$ at a concentration of more than 3 $mol.l^{-1}$, a viscosing compound is preferably added to the liquid phase such as polyethylene glycol, for example polyethylene glycol with an average molecular weight of 6000. Sulphuric acid accelerates a phenomenon of direct sedimentation of the liquid phase through the interface separating the gas bubbles from the foam, but this may be slowed down by means of this viscosing compound.

Generally the concentration of viscosing compound in the liquid phase does not exceed 1% by weight.

The liquid phase of the foam also contains at least one surfactant, agent to promote foam formation, preferably two surfactant agents are used, respectively a betaine, in particular a sulfobetaine, and an oligosaccharide alkyl ether. The association of these two surfactant agents is of interest as it remains surface active irrespective of pH, and is therefore suitable both for a neutral medium, for example for the rinsing of an installation, and for an acid or basic medium, that is to say with acid or basic decontamination reagents.

Generally, the concentration of betaine is 0.2 to 0.5% by weight and the concentration of the oligosaccharide alkyl ether is between 0.3 and 1% by weight.

It is possible for example to use a sulfobetaine such as that sold by SEPPIC under the trade name AMONYL (registered trade mark).

As an example of oligosaccharide alkyl ether which may be used as second surfactant, mention may be made of that sold by SEPPIC under the trade name ORAMIX CG110 (registered trade mark,) and that marketed by ROHM and HASS under the trade name TRITON CG60 (registered trade mark)

As seen above, the contents of surfactant agents, and/or of stabilising or destabilising agents are. chosen in relation to the lifetime of the foam it is wished to obtain. If the foam is intended for cleaning and/or for decontaminating an installation, the contents of decontamination and/or cleaning reagents are chosen in relation to the type of items to be decontaminated and/or cleaned and to the type or extent of required decontamination and/cleaning As an example, the liquid phase of a foam, for example a rinsing foam, which can be used according to the method of the invention, may be made up of an aqueous solution containing:

from 0.2 to 0.5% by weight of betaine, from 0.3 to 1% by weight of an oligosaccharide alkyl ether, and optionally from 0.2 to 1% by weight of a destabilising agent.

In a further example, the liquid phase of a foam, for example a decontamination foam, which may be used according to the invention, may be made up of an aqueous solution containing:

3 to 6 $mol.l^{-1}$ sulphuric acid, 0.1 to 1% by weight of a viscosing compound, 0.2 to 0.5% by weight of betaine, 0.3 to 1% by weight of an oligosaccharide alkyl ether, and optionally, 0.2 to 1% by weight of a destabilising agent.

In another example, the liquid phase of a foam, for example a scouring foam, which may be used according to the invention, may be made up of an aqueous solution containing:

3 to 5 $mol.l^{-1}$ NaOH, 0.1 to 1% by weight of a viscosing compound, 0.2 to 0.5% by weight of betaine, 0.3 to 1% by weight of an oligosaccharide alkyl ether, and optionally 0.2 to 1% by weight of a destabilising agent.

Another variable which contributes to the quality of the foam generated with the method of the invention is the flow rate of the liquid phase arriving in contact with the porous lining. This flow rate may be set by means of a measuring pump. Depending upon the quality of the required foam, the flow rate of the liquid phase is adjusted in relation to the flow rate of the gas phase and to the aspiration of the liquid and gas phases through the porous lining. The flow rate of the liquid phase must also be adjusted in relation to the porous lining, in particular in relation to the pore size of this lining.

Foam quality may also depend upon the manner in which the liquid arrives in contact with the porous lining; by promoting the formation of a coarse foam as soon as contact is made with the porous lining, the quality of the generated foam can be increased. Therefore the mode in which the liquid is sprayed onto the surface of the lining has an influence which may also lead to its greater or smaller homogeneous distribution. The arrival of the liquid phase in contact with the lining may be made for example by means of a spray nozzle, or even by inserting a grid between the arrival of the liquid phase in the chamber and the porous lining, that is to say above the porous lining.

Another variable which acts on the quality of generated foam is the low pressure prevailing downstream from the porous lining, this low pressure causing aspiration of the liquid and gas phases through the porous lining. Also the flow rate of the generated foam is related to this low pressure downstream from the porous lining. In practice, the low pressure chosen must take into account the loss of pressure in the porous lining. On this account, the flow rate of the foam can be controlled when it leaves the porous lining by means of a flow meter, and the value of this flow can be adjusted by means of a low pressure adjustment system.

A further variable acting on the quality of the foam generated by the method of the invention is the type of lining used for this generation. This lining may be any medium offering a throughway permitting flow of the liquid phase and gas phase through the porous lining in order to assure their mixing. The pore openings of the porous lining may preferably be uniformly distributed within the lining volume, these openings preferably being of small size, for example from 100 $\mu$m to a few mm, in order to promote the mixing of the gas phase and the liquid phase and to avoid the onset of air pockets in the foam. However, pores that are too fine may generate considerable pressure losses.

By way of example, the porous lining may, at choice, be either a stack of metal grids, a knitted synthetic fabric of FORAFLON type (registered trade mark), sand, diatoma or perlites, solid gauged beads, or any other material having adequate interstices for foam generation.

Preferably, according to the method of the invention, gauged beads are used, for example gauged glass beads. The value of the pressure loss in the porous medium can then be controlled in precise, reproducible manner by the thickness of the bed of beads and bead diameter. For a bed of gauged glass beads, it is possible firstly to use as basis two conventional ratios valid for incompressible, homogeneous, Newtonian fluids.

Firstly the DARCY ratio which relates a flow rate U of a liquid phase, or velocity of a liquid phase in m/s, a viscosity $\mu$ of the liquid phase in Pa.s, the thickness z of the porous lining crossed by the liquid phase and the gas phase in metres, and the difference in pressure $\Delta P$ in Pascal units between the pressure P1 upstream from the porous lining, and the pressure P2 downstream from the porous lining, is written $U=B.\Delta P/\mu.z$ in which $\Delta P=P1-P2$ and $P1>P2$.

Factor B expressed in $m^2$ is called permeability. This factor is characteristic of the porous medium and is related to its geometry.

Secondly, the KOZENY-CARMAN model permits calculation of the permeability B of a porous medium made up of gauged spheres. The mathematical expression of this model will not be detailed herein. It will be simply be recalled that for an incompressible, Newtonian fluid, permeability is inversely proportional to the square diameter of the spheres forming the bed.

For example, for a liquid phase flow rate of up to 100 l/h, preferably from 5 to 50 l/h, passing through a porous lining with a thickness of 0.08 m and formed of glass beads having a diameter of 1.6 mm, the low pressure set up downstream from the porous lining may be between $5\times10^3$ and $80\times10^3$ Pa, preferably between $30\times10^3$ and $60\times10^3$ Pa.

A further variable acting on the quality of the generated foam is the shape of the chamber in which the porous lining is placed. It can for example be envisioned to increase the surface area of the free section of this chamber having a constant lining thickness, a constant liquid phase flow rate and a constant low pressure, in order to enrich the gas mixture. The chamber may be covered with a lid having at least one opening to permit inflow of the gas chosen to produce the foam, or it may be uncovered if the gas used to generate the foam is ambient air. The flow rate of the foam leaving the porous lining will therefore also be related to the geometry of the chamber.

With the method of the invention, it is possible to generate foams having an expansion of 5 to 40.

According to the invention, the gas phase used to implement the method if the invention may be air, nitrogen, oxygen, a neutral gas such as argon or helium which may be used alone or in combination.

The invention also relates to a method for placing a foam in circulation in an installation, comprising a step consisting of generating a foam by aspiration of an appropriate liquid phase and an appropriate gas phase through a porous lining at a first end of the installation, such that the generated foam is inserted into said installation and travels through it as far as a second end of the installation, aspiration being conducted by setting up a low pressure in said installation at and after said second end.

According to this method, the low pressure set up in the installation at and after said second end initiates aspiration of the liquid and gas phases through the porous lining and subsequently the placing in circulation of the foam inside the installation.

According to the invention, this method of placing a foam in circulation in an installation may be applied to a method for cleaning an installation with a cleaning foam. The liquid phase then comprises one or more cleaning agents.

If cleaning also comprises scouring, the liquid phase may also contain a scouring agent.

According to the invention, the cleaning foam may also be a decontaminating foam, and in this case comprises one or more decontaminating agents.

These decontaminating agents may, for example, be radioactive or bactericidal decontamination agents depending upon the installation to be cleaned.

The cleaning and decontaminating agents are those previously described.

According to a first embodiment of the method of the invention, the foam may be received in a collecting tank after the second end of the chamber and be naturally, chemically and/or mechanically destabilised. Natural destabilisation is made with the use of a foam having a limited lifetime, chemical destabilisation is achieved by adding to the foam, in this collecting tank, one of the destabilisation agents previously cited, and mechanical destabilisation may be made by means of an ultrasound generator for example, a centrifuging machine or a blade turbine.

According to a second embodiment of the method for placing a foam in circulation in an installation, the method may, in addition, comprise the steps consisting of collecting the foam after the second end of the installation, destabilising the collected foam such as to obtain a liquid, and of using at least part of said liquid as liquid phase to generate the foam placed in circulation in said installation. This embodiment may also be called recycling mode.

According to one preferred variant of the second embodiment of the invention just described, the liquid may be purified before being used as liquid phase to generate foam. The purpose of this purification is for example, in respect of installation cleaning and/or decontaminating methods, to remove the waste carried by the circulation of the foam in the installation. This purification may be made by means of adequate filters for example.

The invention also relates to a foam generating system to apply the method of the invention. This system comprises:

a chamber comprising at least one inlet opening and one outlet opening, a porous lining placed between the inlet and outlet openings of the chamber, means for inserting in said chamber a liquid phase and a gas phase through said, at least one, inlet opening, means for aspirating said liquid phase and said gas phase through the porous lining, the generated foam being evacuated from said chamber by said aspiration means through said, at least one, outlet opening.

The chamber may be of any shape, of round shape for example, and made of a material which may be chosen in relation to the porous lining, to the liquid phase, and gas phase used, and in relation to the low pressure applied to generate the foam. This chamber is preferably impervious.

If the gas used is ambient air, the chamber may be uncovered.

The porous lining which may possibly be used is described above.

The insertion means used to add a liquid phase to said chamber through at least one inlet opening may, for example, comprise a measuring pump permitting entry of the liquid phase into the chamber, this pump possibly being provided with means to measure liquid phase flow rate, for example a flow meter. This pump may be connected to a preparation and storage tank for the liquid phase.

In order to distribute the liquid phase in homogeneous manner over the porous lining, a spray nozzle or a grid may be used, preferably a spray nozzle. This nozzle or this grid, by assuring proper distribution of the liquid, is able to promote the creation of a coarse foam above the porous lining as soon as the liquid phase enters this lining, thereby increasing the quality of the generated foam.

The means permitting entry of the gas phase into said chamber may comprise adjustment means to adjust the entry pressure of the gas into said chamber and optionally a reservoir for said gas.

If the gas phase is made up of ambient air, aspiration of the liquid and gas phases through the porous lining causes aspiration of ambient air, in which case, upstream from the porous lining, at least one inlet may be provided on the chamber for ambient atmospheric air, optionally equipped with a flow meter.

The aspiration means for said liquid phase and said gas phase through the porous lining, or means for creating a low pressure, may for example be a vacuum pump optionally fitted with a condensate trap, this pump being able to conduct evacuation of the generated foam from the chamber.

The system may be equipped with a valve or solenoid valve used to set and adjust the low pressure downstream from the lining in the chamber. The system of the invention may also be equipped with measuring means to measure the low pressure in said chamber.

The invention also related to a system for placing a foam in circulation in an installation, the installation comprising a first end and a second end, the first and second ends delimiting at least part of the installation in which the foam is to be placed in circulation, this system comprising:

a foam generation system such as described previously, and sealed connection means between said, at least, one outlet opening of the chamber and the first end of the installation, the aspiration means for said liquid phase and said gas phase through the porous lining being positioned at the second end of the installation such as to set up a low pressure in said part of the installation in which the foam is to be placed in circulation.

The system for placing a foam in circulation in an installation is particularly advantageous for cleaning and/or decontaminating said installation.

The chamber, the lining, the insertion means for adding the liquid phase to said chamber, and the insertion means for adding the gas phase to said chamber may be those previously described. The sealed connection means may for example be seals designed such as to withstand the chemical composition of the generated foam, and to withstand the low pressure required to generate the foam by aspiration of the liquid and gas phases through the porous lining.

The aspiration means to aspirate the liquid and gas phases through the porous lining and set up a low pressure in said part of the installation in which the foam is to circulate, may be those previously described and may in addition comprise a condensate trap. This system may also comprise the adjustment and measurement means previously described.

The system for generating a foam and placing a foam in circulation in an installation according to the invention may also comprise a foam flow meter placed downstream from the porous lining such that it is able to measure the quantity of foam generated and to adjust the low pressure in the installation and the inflow rates of the gas and liquid phases into the chamber.

This system may further comprise a foam collector tank placed at the second end of the installation. It may also comprise a pressure sensor, discharge or collection valves for a liquid phase derived from destabilisation of said foam.

According to the invention, the system may also comprise means for collecting a liquid, derived from destabilisation of the foam, in the foam collector tank and means for pumping said liquid as far as the insertion means for adding the liquid phase to the chamber of the foam generation system.

This system may then comprise insulation valves, a system for pumping this liquid from the foam collector tank as far as the preparation and storage tank for the liquid phase used to generate the foam. Said liquid may then, via the insertion means for the liquid phase, be added to the chamber containing the porous lining for example by means of a measuring pump, from the liquid phase preparation and storage tank.

According to the invention, the system may in this case operate either in single flow-through mode or in recycling mode.

When the system of the invention operates in single flow-through mode, the foam is collected and stored in a collector tank which may comprise means for destabilising the foam in order to accelerate its return to the liquid state. Destabilisation may be natural, or accelerated for example using a mechanical system such as those previously described or by chemical means using a destabilising agent such as alcohol for example. The tank may then be emptied by means of a valve either in continuous or periodic manner.

In recovery mode, also called recycling mode, the liquid derived from natural or accelerated destabilisation of the foam, after a first flow through the installation to be decontaminated and/or cleaned for example, is periodically or continuously recovered from the collector tank by means of a recovery pump or recycling pump and is re-injected into the liquid phase preparation and storage tank connected to the measuring pump for the liquid phase.

According to the invention, the recycling operating mode is particularly preferred for industrial application of the proposed decontamination system.

According to the invention, when the recycling mode is used, means for purifying the recovered liquid may be placed downstream from the foam collector tank and upstream from the insertion means for adding the liquid phase to the chamber of the foam generation system, for example from the liquid phase preparation and storage tank.

Other advantages and characteristics of the invention will become clearer on reading the following description given as a non-restrictive illustration, with reference to the appended drawings.

DESCRIPTION OF EMBODIMENTS OF THE INVENTION

Figure 1:
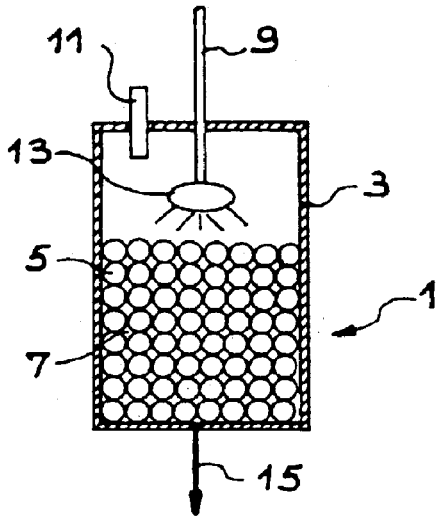
FIG. 1 is a cross section view of one embodiment of the foam generation system according to the invention.

FIG. 1 is a diagram illustrating an embodiment of a system 1 for generating foam according to the invention, comprising a chamber 3, a porous lining 5 placed in said chamber 3, means 9 and 11 with which to insert in said chamber a liquid phase and a gas phase respectively, appropriate for foam generation, and aspiration means 15 to aspirate said liquid phase and said gas phase through porous lining 5, the generated foam being evacuated from said chamber 3 by these aspiration means 15.

Porous lining 5 is made of gauged glass beads, leaving interstices 7 through which the liquid phase percolates.

Means 9 and 11 permitting entry into the chamber of a liquid phase and a gas phase respectively, and in particular means 9 for adding the liquid phase to the chamber comprise spray means 13 to spray the liquid phase in the chamber onto the porous lining.

Figure 2:
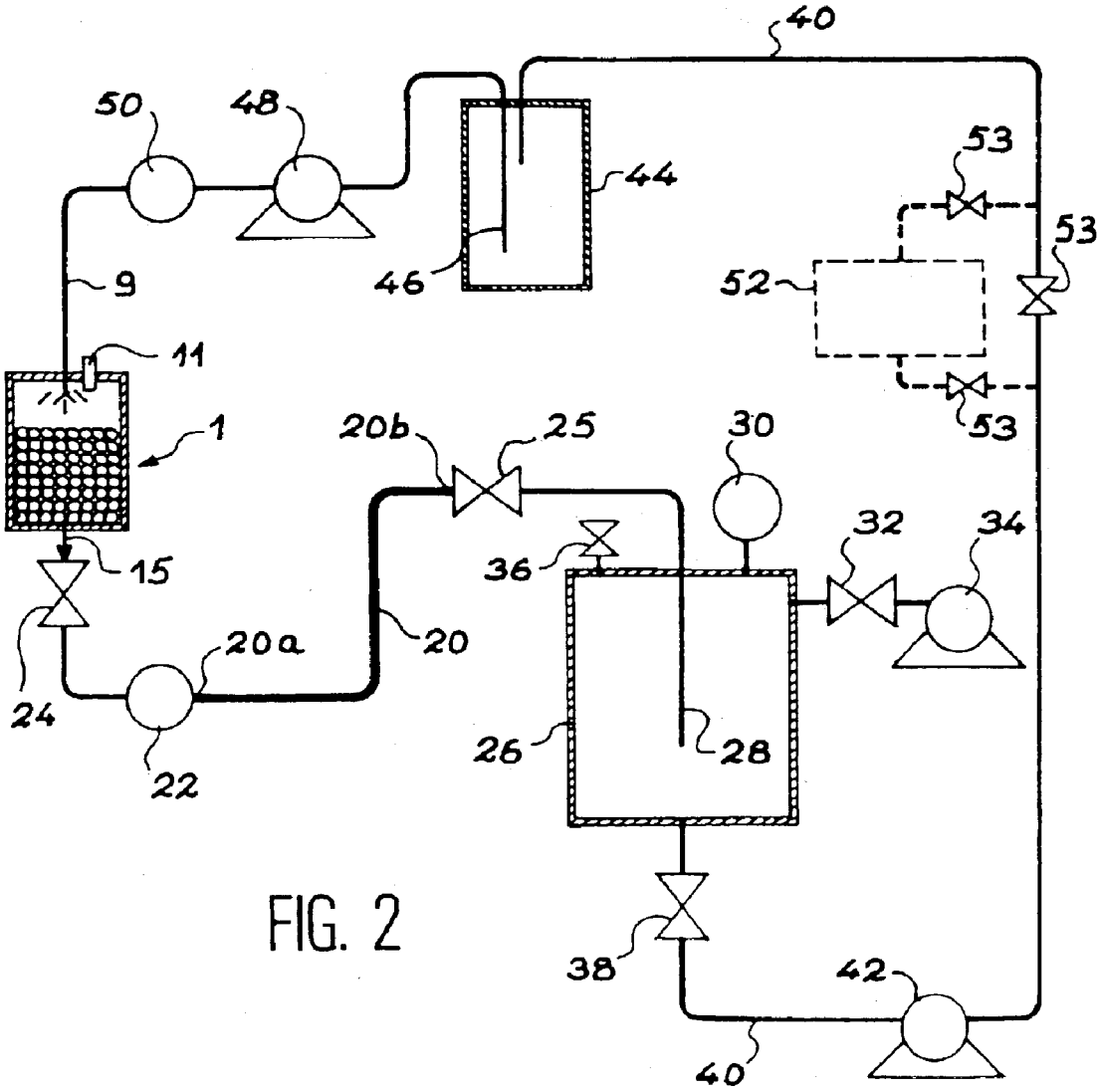
FIG. 2 is a diagram illustrating an embodiment of a cleaning system for an installation, which places a foam in circulation using the foam generation system outlined in FIG. 1.

FIG. 2 is a diagram illustrating a system for cleaning an installation 20 with a foam, installation 20 comprises a first end 20*a* and a second end 20*b*, the first end 20*a* and the second end 20*b* delimiting the part of the installation 20 to be cleaned by the foam. The cleaning system comprising a system 1 for generating a foam such as previously described, sealed connection means between system 1 for generating a foam and the installation to be cleaned, and means 30, 32 and 34 to set up a low pressure in said installation. Means 30, 32 and 34 are respectively a pressure sensor, a pressure insulation and adjustment valve, and a vacuum pump intended to set up the low pressure in installation 20 and system 1.

This cleaning system also comprises a reservoir 44 for preparing and storing the liquid phase. A measuring pump 48, by means of a descending pipe 46, is used to withdraw the liquid phase from this reservoir 44 and to drive this liquid phase towards system 1 for generating foam. A flow meter 50 is placed upstream from the foam generation system in order to control the flow rate of the liquid phase inserted in this system 1.

This cleaning system is also fitted with an insulation valve 24 placed between system 1 and installation 20, with a foam flow meter 22 placed between valve 24 and installation 20, and with a foam collector tank 26 at the second end 20*b* of installation 20.

Foam collector tank 26 comprises a valve 36 to place the installation under atmospheric pressure.

After being generated in system 1, by aspiration of appropriate liquid and gas phases through the porous lining by means of vacuum pump 34, the foam passes through installation 20 from the first end 20*a*, then after second end 20*b* it is led by means of descending piping 28 to the bottom of collector tank 26.

According to one first embodiment of the invention, the foam may be stored in this collector tank 26 and undergo destabilisation by a chemical destabilising agent and/or a mechanical system such as those previously described, to accelerate its return to liquid form. The tank may then be emptied by a valve 38.

According to a second embodiment, the foam is destabilised by chemical and/or mechanical means in collector tank 26 to form a liquid which by means, called recycling or recovery means, is led back to spray means 9 this liquid again forming the liquid phase of a foam.

These recycling means comprise for example a valve 38, a recycling pump 42 and ducts 40, leading this liquid into the liquid phase preparation and storage reservoir 44, and it is then taken back by means of descending pipe 46, measuring pump 48 and flow meter 50 to system 1.

This second embodiment of the invention, or recycling mode, is particularly preferred for industrial application of a decontamination and/or cleaning system of the invention.

According to one variant of this second embodiment, the system may also comprise a purification device 52 for the liquid waste leaving the collector tank 26, through which the liquid transits, to remove the cleaning and/or decontamination waste before it reaches storage tank 44. The inflow and outflow of the liquid waste in and out of purification device 52 may, for example, be controlled by means of valves 53.

Examples of Operation of the System for Circulating within an Installation a Foam Generated by Device 1 of the Invention.

In the following examples the-liquid phase used is an aqueous solution containing:

0/8% by weight of ORAMIX CG 110 (registered trade mark), 0.3% by weight of AMONYL (registered trade mark), 0.25% by weight of pentanol-2, and the gas phase is air.

The chamber used in these examples for the generation of foam has an inner diameter of 30 mm, and the installation is a cylindrical pipe having an inner diameter substantially identical to that of the chamber.

EXAMPLE 1

Influence of Porous Lining Thickness on Foam Circulation Rate at Constant Low Pressure In this example, the porous lining is a bed of spherical glass beads, 1.6 mm in diameter, and the length of the cylindrical pipe is 4 m. Tests were conducted on two thicknesses z of the bed of beads of 0.05 m and 0.08 m respectively, and at a constant low pressure of $15\times10^3$Pa.

For each test, the circulation rate of foam $V_m$ in $m.s^{-1}$ was measured in relation to the flow rate in 1/h of the liquid phase Ql crossing through the porous lining.

Table 1 below groups together the results obtained in this example.

TABLE 1

| TEST | $60_a$ | $60_b$ | $60_c$ | $62_a$ | $62_b$ | $62_c$ |
|---|---|---|---|---|---|---|
| LINING THICKNESS z (m) | 0.05 | 0.05 | 0.05 | 0.08 | 0.08 | 0.08 |
| FLOW RATE OF LIQUID Q1 (1/h) | 5 | 10 | 15 | 5 | 10 | 15 |
| FOAM VELOCITY $V_m$ (m/s) | 0.054 | 0.051 | 0.053 | 0.021 | 0.027 | 0.030 |

Figure 3:
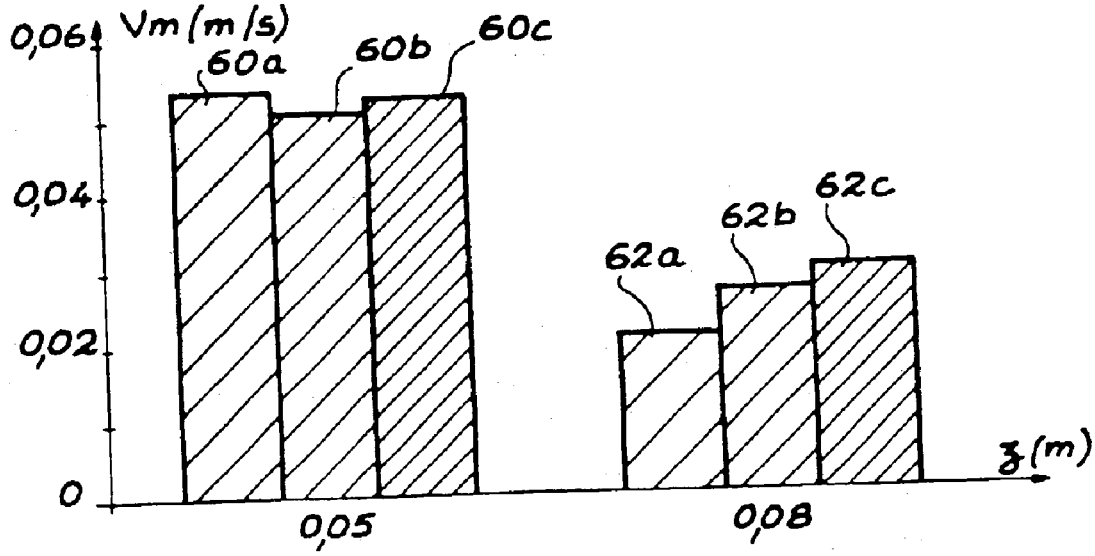
FIG. 3 is a graph illustrating the influence of bead bed thickness of a porous lining on the circulation rate of a foam, at constant low pressure, when leaving a foam generator of the invention.

FIG. 3 is a graph illustrating these results, in which columns $\mathbf{60}_a$, $\mathbf{60}_b$, $\mathbf{60}_c$, $\mathbf{62}_a$, $\mathbf{62}_b$, and $\mathbf{62}_c$, represent tests with the same reference, $V_m$ the foam velocity in m/s and Z the thickness of the bed of beads in m.

These results show that the circulation rate of the foam is inversely proportional to the thickness of the porous lining.

EXAMPLE 2

Influence of Bead Diameter of the Porous Lining on Foam Circulation Rate at Constant Low Pressure In this example, the diameter of the glass beads of the porous lining is 3 mm or 1.6 mm, lining thickness z is 0.08 m, low pressure is constant at $15\times10^3$ Pa, and the length of the cylindrical pipe is 4 m.

The foam circulation rate $V_m$ in m/s in the cylindrical pipe is measured.

The liquid and gas phases used are the same as those described in example 1.

Different tests were conducted by varying the flow rate of the liquid phase Ql in l/h crossing through the porous lining.

Table 2 below groups together the results of the measurements taken in this example.

TABLE 2

| TESTS | $70_a$ | $70_b$ | $70_c$ | $70_d$ | $62_a$ | $62_b$ | $62_c$ |
|---|---|---|---|---|---|---|---|
| BEAD DIAMETER OF POROUS LINING (mm) | 3 | 3 | 3 | 3 | 1.6 | 1.6 | 1.6 |
| BED THICKNESS z (in m) | 0.08 | 0.08 | 0.08 | 0.08 | 0.08 | 0.08 | 0.08 |
| Q1 in l/h | 5 | 10 | 15 | 20 | 5 | 10 | 15 |
| $V_m$ (m/s) | 0.15 | 0.14 | 0.14 | 0.17 | 0.021 | 0.027 | 0.030 |

Figure 4:
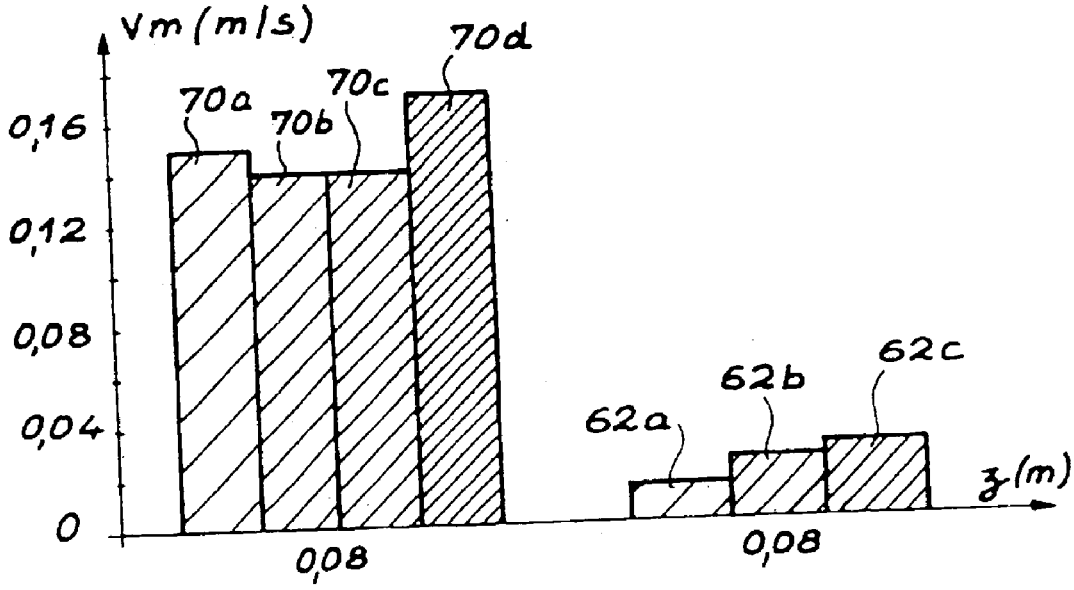
FIG. 4 is a graph illustrating the influence of bead diameter of a porous lining on the circulation rate, at constant low pressure, of a foam generated according to the method of the invention when leaving a foam generator of the invention.

FIG. 4 is a graph illustrating these results in which references $\mathbf{70}_{a\text{-}d}$ and $\mathbf{62}_{a\text{-}c}$ relate to those given in the tests in table 2.

These results show that foam circulation rate is greater, the greater the diameter of the beads of the porous lining.

EXAMPLE 3

Influence of Liquid Phase Flow Rate on Foam Expansion

In this example, the liquid and gas phases used are the same as those described in the preceding examples and the length of the cylindrical pipe is 4 m.

The tests in this example are conducted for two thicknesses z of the porous lining: 0.08 m (tests 80) and 0.11 m (tests 82). The bead diameter of the porous lining is 0.003 m for all tests and low pressure is constant at $15\times10^3$ Pa.

The foam circulation rate observed in each group of tests is constant: namely 0.15 m/s for tests 80; and 0.12 m/s for tests 82.

Foam expansion F on leaving the circuit is measured in relation to flow rate Ql of the liquid phase in l/h.

Table 3 below groups together the results obtained in this example.

TABLE 3

| | | | | | |
|---|---|---|---|---|---|
| TESTS 80 | | | | | |
| z = 0.08 m | Q1 in l/h | 3.6 | 9 | 14.4 | 18.8 |
| $V_m$ = 0.15 m/s | F | 51 | 26 | 17 | 15 |
| TESTS 82 | | | | | |
| z = 0.11 m | Q1 in l/h | 3.6 | 9 | 14.4 | 18.8 |
| $V_m$ = 0.12 m/s | F | 54 | 22 | 13 | 11 |

Figure 5:
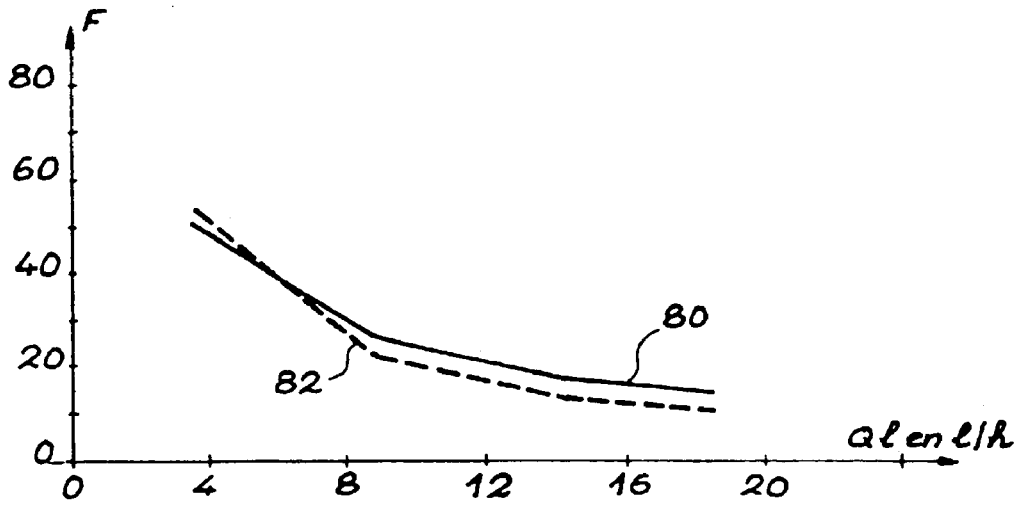
FIG. 5 is a graph illustrating the influence of liquid phase flow rate on foam expansion, at constant low pressure, measured for two bead diameters of the porous lining.

FIG. 5 is a graph illustrating the results of table 3, in which references 80 and 82 respectively relate to tests 80 and 82.

These results show that at constant depression, foam expansion F decreases when the flow rate Ql of the liquid phase increases. Therefore, by choosing the flow rate of the liquid phase it is possible to determine the quality of the foam.

EXAMPLE 4

Influence of Low Pressure on Foam Circulation Rate

In this example, the liquid and gas phases of example 1 are used, the length of the cylindrical pipe is 15 metres, bead diameter is 0.003 m and the thickness of the porous lining is 0.08 m.

Foam circulation rate was measured in relation to the low pressure applied in the circuit.

Table 4 below groups together the results obtained in this example

TABLE 4

| | | | | | | |
|---|---|---|---|---|---|---|
| LOW PRESSURE IN CIRCUIT ($\times 10^2$Pa) | 150 | 200 | 300 | 350 | 400 | 450 |
| $V_m$ (m/s) | 0.08 | 0.16 | 0.23 | 0.26 | 0.32 | 0.35 |

Figure 6:
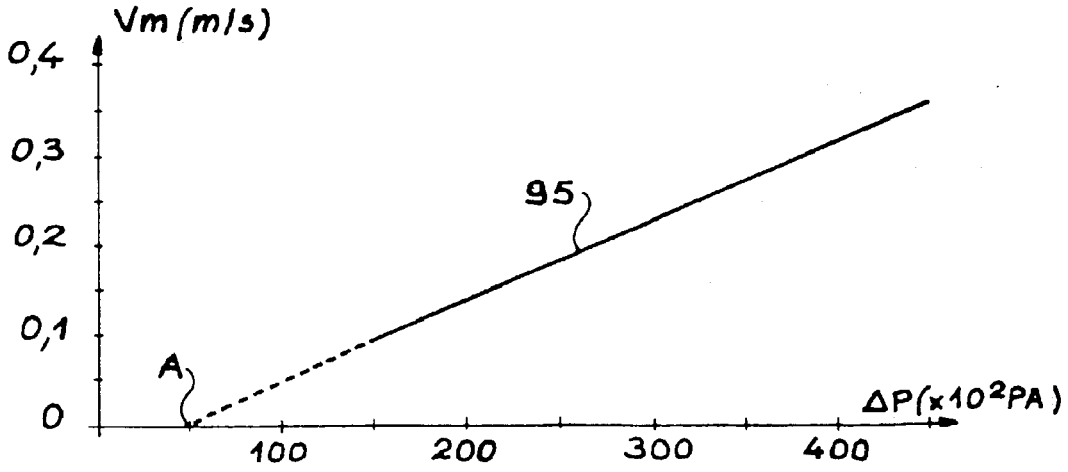
FIG. 6 is a graph illustrating the influence of low pressure downstream from the porous lining on the circulation rate of a foam generated according to the method of the invention.

FIG. 6 is a graph illustrating the results of table 4.

In this figure point A was obtained by extrapolating curve 95 linear fashion.

This point A corresponds to the minimum low pressure $\Delta P$ in the circuit measured in relation to atmospheric pressure, starting from which the foam shows rheologic behaviour of Newtonian type. Under the conditions described in this example, $\Delta P=43\times10^2$ Pa.

These results show that for constant foam generator characteristics (bead diameter of the porous lining, thickness of the porous lining) foam circulation rate is a linear function of reduced pressure.

What is claimed is:

1. System for generating a foam comprising:

a chamber provided with at least one inlet opening and at least one outlet opening, a porous lining placed between the inlet and outlet openings of the chamber, wherein the porous lining acts as a contacter between the gas phase and the liquid phase, such that the initial gas phase-liquid phase mixture is made in the porous lining in which interfaces are created, said porous lining being a medium offering a throughway permitting flow of the liquid phase and the gas phase through the porous lining in order to assure simultaneous mixing of the liquid phase and the gas phase and the generation of a foam, means for inserting the liquid phase and means for inserting the gas phase in said chamber, through the said, at least one, inlet opening, means for creating low pressure in said chamber and aspirating the foam generated in the porous lining through said, at least one, outlet opening, wherein said means for inserting in said chamber the liquid phase, said means for inserting in said chamber the gas phase, and said means for aspirating the generated foam from said chamber are such that the energy required for the mixture of the liquid phase and of the gas phase and for the generation of the foam is provided by the aspirating means.

2. System for placing a foam in circulation in an installation, the installation comprising a first end and a second end, the first and second ends delimiting at least part of the installation in which the foam is to be to in circulation, said system comprising:

the foam generation system according to claim 1, and scaled connection means between said, at least one, outlet opening of the chamber and the first end of the installation, said means for aspirating being positioned at the second end of the installation such as to set up a low pressure in said part of the installation in which the foam is to be placed in circulation.

3. System according to claim 1, comprising in addition at least one spray means for spraying the liquid phase in the chamber.

4. System according to claim 2, comprising in addition at least one spray means for spraying the liquid base in the chamber.

5. System according to claim 3, in which the spray means is a nozzle or grid.

6. System according to claim 1, in which the porous lining is made up of a material chosen from among a stack of metal grids, a knitted synthetic fibre, sand, diatoma, perlites, gauged solid beads, and material having interstices.

7. System according to claim 2, in which the porous lining is made up of a material chosen from among a stack of metal grids, a knitted synthetic fibre, sand, diatoma, perlites, gauged solid beads, and a material having interstices.

8. System according to claim 3, in which the porous lining is made up of a material chosen from among a stack of metal grids, a knitted synthetic fibre, sand, diatoma, perlites, gauged solid beads, and a material having interstices.

9. System according to claim 4, in which the porous lining is made up of a material chosen from among a stack of metal grids, a knitted synthetic fibre, sand diatoma, perlites, gauged solid beads, and a material having interstices.

10. System according to claim 5, in which the porous lining is made up of a material chosen from among a stack of metal grids, a knitted synthetic fibre, sand, diatoma, perlites, gauged solid beads, and a material having interstices.

11. System according to claim 1, in which the insertion means for adding the gas phase to the chamber is at least one inlet opening for ambient atmospheric air.

12. System according to claim 1, in which the insertion means for adding a liquid phase to said chamber through at least one inlet opening comprise a measuring pump and flow measurement means.

13. System according to claim 11, in which the insertion means for adding a liquid phase to said chamber through at least one inlet opening comprise a measuring pump and flow measurement means.

14. System according to claim 1, in which the aspiration means comprise a vacuum pump.

15. System according to claim 2, in which the aspiration means comprise a vacuum pump.

16. System according to claim 3, in which the aspiration means comprise a vacuum pump.

17. System according to claim 4, in which the aspiration means comprise a vacuum pump.

18. System according to claim 5, in which the aspiration means comprise a vacuum pump.

19. System according to claim 6, in which the aspiration means comprise a vacuum pump.

20. System according to claim 7, in which the aspiration means comprise a vacuum pump.

21. System according to claim 8, in which the aspiration means comprise a vacuum pump.

22. System according to claim 9, in which the aspiration means comprise a vacuum pump.

23. System according to claim 10, in which the aspiration means comprise a vacuum pump.

24. System according to claim 11, in which the aspiration means comprise a vacuum pump.

25. System according to claim 12, in which the aspiration means comprise a vacuum pump.

26. System according to claim 13, in which the aspiration means comprise a vacuum pump.

27. System according to claim 14, in which the vacuum pump is fitted with a condensate trap.

28. System according to claim 15, in which the vacuum pump is fitted with a condensate trap.

29. System according to claim 2, comprising in addition a foam collector tank placed at the second end of the installation.

30. System according to claim 29, comprising in addition collecting means for the liquid derived from destabilisation of the foam in the foam collector tank, and means for pumping said recovered liquid as far as the insertion means for the liquid phase in the chamber of the foam generation system.

31. System according to claim 30, comprising in addition means for the purifying of the recovered liquid, said purification means being placed downstream from the foam collector tank and upstream from the insertion means for the liquid phase into the chamber of the foam generation system.

32. System according to claim 6, in which the insertion means for adding the gas phase to the chamber is at least one inlet opening for ambient atmospheric air.

33. System according to claim 6, in which the insertion means for adding a liquid phase to said chamber through at least one inlet opening comprise a measuring pump and flow measurement means.

34. System according to claim 1, in which the porous lining is made up of a material chosen from among a knitted synthetic fibre, sand, diatoma, perlites, and gauged solid beads.

* * * * *

UNITED STATES PATENT AND TRADEMARK OFFICE

CERTIFICATE OF CORRECTION

PATENT NO. : 6,932,330 B2 
APPLICATION NO. : 10/378882
DATED : August 23, 2005
INVENTOR(S) : Bruno Fournel, Marial Faury and Jean-Marie Le Smedy It is certified that error appears in the above-identified patent and that said Letters Patent is hereby corrected as shown below:

ON THE COVER PAGE (73):

Assignees should be corrected to show (2) separate:
1. Commissariat A L'Energie Atomique, France
2. Compagnie Generale des Matieres Nucleaires, France References Cited (56): U. S. Patent Documents:
2nd entry reads "4,133,773 A 1/1979 Moore ……1/79"; this entry should read "4,133,733 A 1/1979 Simmons……1/79"

Column 2, Line 7: "The principle of the, method of" should be corrected to read "The principle of the method of" (remove comma)

Column 3, Line 53: "at least one surfactant, agent to" should be corrected to read "at least one surfactant agent to" (remove comma)

Column 4, Line 5 to 6: "TRITON CG60 (registered trade mark)" should be corrected to read "TRITON CG60 (registered trade mark)." (add period)

Column 4, Line 8: "destabilising agent are. chosen in" should be corrected to read "destabilising agents are chosen in" (remove period)

Column 10. Line 10: "In the following examples the-liquid phase" should be corrected to read "In the following examples the liquid phase" (remove dash)

Claim 2, Column 13, line 34: The word "scaled" should be replaced with "sealed".

Claim 4, Column13, line 45: The word "base" should be replaced with "phase".

Claim 6, Column 13, line 52: The word "a" should be added to read "gauged solid beads, and a material having interstices."

UNITED STATES PATENT AND TRADEMARK OFFICE

CERTIFICATE OF CORRECTION

PATENT NO. : 6,932,330 B2
APPLICATION NO. : 10/378882
DATED : August 23, 2005
INVENTOR(S) : Bruno Fournel, Marial Faury and Jean-Marie Le Smedy It is certified that error appears in the above-identified patent and that said Letters Patent is hereby corrected as shown below:

Claim 9, Column 13, line 64: A comma should be added after "sand" to show "a knitted synthetic fibre, sand, diatoma, perlites, gauged solid beads, and a material having interstices."

Signed and Sealed this

Twenty-ninth Day of August, 2006

JON W. DUDAS
*Director of the United States Patent and Trademark Office*